US011708659B2

(12) United States Patent
Allen et al.

(10) Patent No.: US 11,708,659 B2
(45) **Date of Patent: *Jul. 25, 2023**

(54) LID HINGE FOR A LAUNDRY TREATING APPLIANCE

(71) Applicant: WHIRLPOOL CORPORATION, Benton Harbor, MI (US)

(72) Inventors: Ryan L. Allen, Kalamazoo, MI (US); Andria Bauman, Stevensville, MI (US); James J. Collene, Bucyrus, OH (US); James Oddo, Fremont, OH (US); Eric Osler, Mishawaka, IN (US); Nick Sir Louis, Seville, OH (US); Philip R. Thompson, Alvada, OH (US); Igor Viveiros, Limeira (BR)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/559,703

(22) Filed: Dec. 22, 2021

(65) Prior Publication Data

US 2022/0112651 A1 Apr. 14, 2022

Related U.S. Application Data

(60) Continuation of application No. 17/128,691, filed on Dec. 21, 2020, now Pat. No. 11,236,461, which is a continuation of application No. 16/863,309, filed on Apr. 30, 2020, now Pat. No. 10,907,296, which is a division of application No. 15/907,529, filed on Feb. 28, 2018, now Pat. No. 10,689,790.

(51) Int. Cl.
*D06F 39/14* (2006.01)
*D06F 23/04* (2006.01)

(52) U.S. Cl.
CPC ..... *D06F 39/14* (2013.01); *D06F 23/04* (2013.01)

(58) Field of Classification Search
CPC ..... E05F 1/1261; E05Y 2900/30; E05Y 2900/312; Y10T 16/5383; D06F 39/14; D06F 23/04
See application file for complete search history.

(56) References Cited

U.S. PATENT DOCUMENTS

| | | | |
|---|---|---|---|
| 4,787,121 | A | 11/1988 | Racenis et al. |
| 7,243,396 | B2 | 7/2007 | Vanini |
| 7,610,656 | B2 | 11/2009 | Vanini |
| 7,676,888 | B2 | 3/2010 | Vanini |
| 8,250,706 | B2 | 8/2012 | Vanini |
| 8,938,854 | B2 | 1/2015 | Lanzani |
| 9,080,365 | B2 | 7/2015 | Collene et al. |
| 2009/0064458 | A1 | 3/2009 | Vanini |
| 2011/0017191 | A1 | 1/2011 | White et al. |
| 2013/0291337 | A1 | 11/2013 | Vanini |
| 2014/0150212 | A1 | 6/2014 | Collene et al. |

(Continued)

FOREIGN PATENT DOCUMENTS

DE 102015103234 A1 9/2016

*Primary Examiner* — Matthew W Ing
(74) *Attorney, Agent, or Firm* — McGarry Bair PC

(57) ABSTRACT

A hinge for a laundry treating appliance has a housing having a portion received by an aperture in the shroud. The housing also has a first end comprising a mouth adapted to couple with the shroud. The hinge further has a bracket that has a first end connected to the lid and a second end fastened to the housing and the bracket is received in the aperture in the shroud.

20 Claims, 6 Drawing Sheets

(56) References Cited

U.S. PATENT DOCUMENTS

| | | | |
|---|---|---|---|
| 2014/0208542 | A1 | 7/2014 | White |
| 2015/0354261 | A1 | 12/2015 | Dora |
| 2017/0138106 | A1 | 5/2017 | Stuke |
| 2018/0238093 | A1 | 8/2018 | Rommelmann |
| 2019/0032270 | A1 | 1/2019 | Kim et al. |

LID HINGE FOR A LAUNDRY TREATING APPLIANCE

CROSS-REFERENCE TO RELATED APPLICATION

The present application is a continuation of U.S. patent application Ser. No. 17/128,691, filed Dec. 21, 2020, now U.S. Pat. No. 11,236,461, issued Feb. 1, 2022, which is a continuation of U.S. patent application Ser. No. 16/863,309, filed Apr. 30, 2020, now U.S. Pat. No. 10,907,296, issued Feb. 2, 2021, which is a divisional of U.S. patent application Ser. No. 15/907,529, filed Feb. 28, 2018, now U.S. Pat. No. 10,689,790, issued Jun. 23, 2020, all of which are hereby incorporated by reference herein in their entirety.

BACKGROUND

Laundry treating appliances, such as washing machines, typically include a rotatable drum defining a treating chamber in which laundry items are placed for treatment according to an automatic cycle of operation implemented by the appliance. Liquid, such as water or a mixture of water and one or more treating chemistries, is supplied to the treating chamber during the automatic cycle of operation to treat the laundry. The liquid is collected within a tub surrounding the drum and is either drained from the appliance or recirculated for application to the laundry items. To access the treating chamber, lids are typically provided on vertical access laundry treating appliances with hinges that allow the lid to be opened and closed.

SUMMARY

One aspect of the disclosure is a hinge for a laundry treating appliance having a lid. The hinge has a housing having a portion received by an aperture in a shroud of the laundry treating appliance. The housing has a first end comprising a mouth adapted to couple with the shroud. The hinge also has a bracket with a first end connected to the lid and a second end fastened to the housing and the bracket is received in the aperture in the shroud.

Another aspect of the disclosure is a hinge for a laundry treating appliance having a lid. The hinge has a housing having a first end comprising a mouth adapted to couple with a shroud of the laundry treating appliance, a bracket with a first end connected to the lid and a second end fastened to the housing and the bracket received in an aperture in the shroud, and a hook extending vertically from the housing.

DESCRIPTION

To access the treating chamber of a vertical access laundry treating appliance, lids are typically provided with hinges that allow the lid to be opened and closed. Providing a simplified hinge that is easy to install and uses less fasteners than traditional hinges is contemplated by the current disclosure.

Figure 1:
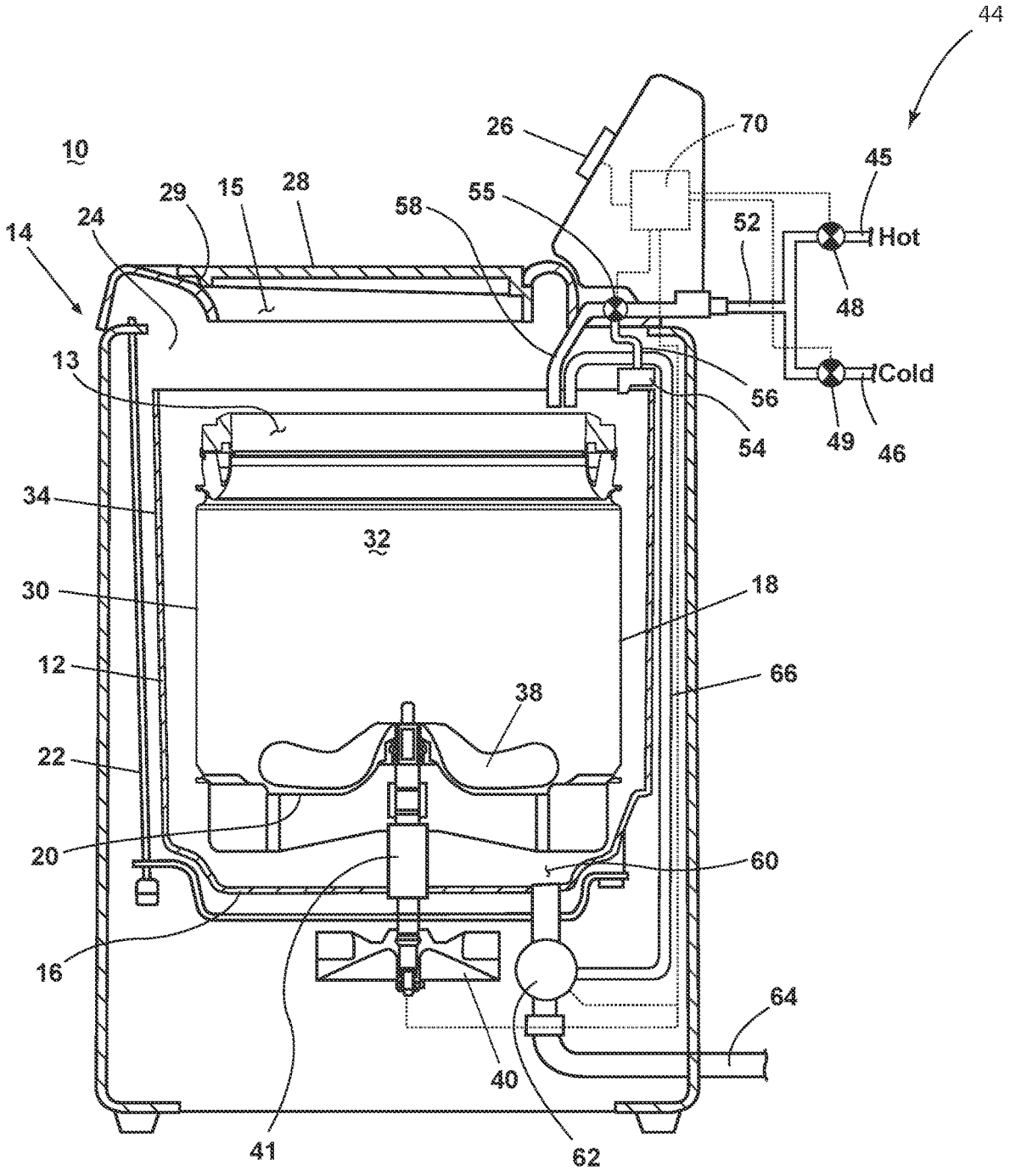
FIG. 1 is a schematic view of a laundry treating appliance in the form of a washing machine according to the present disclosure.

FIG. 1 is a schematic view of a laundry treating appliance according to an aspect of the disclosure herein. The laundry treating appliance can be any appliance which performs a cycle of operation to clean or otherwise treat items placed therein, non-limiting examples of which include a horizontal or vertical axis clothes washer or washing machine; a combination washing machine and dryer; a tumbling or stationary refreshing/revitalizing machine; an extractor; a non-aqueous washing apparatus; and a revitalizing machine.

As used herein, the term "vertical axis" washing machine refers to a washing machine having a rotatable drum that rotates about a generally vertical axis relative to a surface that supports the washing machine. However, the rotational axis need not be perfectly vertical to the surface. The drum can rotate about an axis inclined relative to the vertical axis, with fifteen degrees of inclination being one example of the inclination. Similar to the vertical axis washing machine, the term "horizontal axis" washing machine refers to a washing machine having a rotatable drum that rotates about a generally horizontal axis relative to a surface that supports the washing machine. The drum can rotate about the axis inclined relative to the horizontal axis, with fifteen degrees of inclination being one example of the inclination.

As illustrated in FIG. 1, the washing machine 10 can include a structural support system comprising a cabinet 14 that defines a housing, within which a laundry holding system resides. An access opening 15 can be provided in the cabinet 14 to access the laundry holding system. The cabinet 14 can be a housing having a chassis and/or a frame, to which decorative panels may or may not be mounted, defining an interior that receives components typically found in a conventional washing machine, such as motors, pumps, fluid lines, controls, sensors, transducers, and the like. Such components will not be described further herein except as necessary for a complete understanding of the disclosure.

The laundry holding system of the illustrated exemplary washing machine 10 can include a rotatable basket 30 having an open top 13 that can be disposed within the interior of the cabinet 14 and can define a treating chamber 32 for receiving laundry items for treatment. The open top can be aligned with the access opening 15. A tub 34 can also be positioned within the cabinet 14 and can define an interior 24 within which the basket 30 can be positioned. The tub 34 can have a generally cylindrical side or tub peripheral wall 12 closed at its bottom end by a base 16 that can at least partially define a sump 60.

The rotatable basket 30 can have a generally peripheral side wall 18, which is illustrated as a cylindrical side wall, closed at the basket end by a basket base 20 to at least partially define the treating chamber 32. The basket 30 can be rotatably mounted within the tub 34 for rotation about a vertical basket axis of rotation and can include a plurality of perforations, such that liquid can flow between the tub 34 and the rotatable basket 30 through the perforations. While the illustrated washing machine 10 includes both the tub 34 and the basket 30, with the basket 30 defining the treating chamber 32, it is within the scope of the disclosure for the laundry treating appliance to include only one receptacle, with the receptacle defining the laundry treating chamber for receiving the load to be treated.

A cabinet shroud 29 is provided at the top of the cabinet 14 and can define the access opening 15. The shroud 29 can curve downwards toward the treating chamber 32 to direct laundry items into the basket 30. The shroud 29 can overlie a portion of the basket 30 such that the laundry items do not fall between the basket 30 and the tub 34. A selectively openable lid 28 can provide access into the treating chamber 32 through the access opening 15 of the basket 30.

A laundry mover 38 can be rotatably mounted within the basket 30 to impart mechanical agitation to a load of laundry placed in the basket 30. The laundry mover 38 can be oscillated or rotated about its vertical axis of rotation during a cycle of operation in order to produce load motion effective to wash the load contained within the treating chamber 32. Other exemplary types of laundry movers include, but are not limited to, an impeller, an agitator, a wobble plate, and a hybrid impeller-agitator.

The basket 30 and the laundry mover 38 can be driven by a drive system 40 that includes a motor 41, which can include a gear case, operably coupled with the basket 30 and laundry mover 38. The motor 41 can rotate the basket 30 at various speeds in either rotational direction about the vertical axis of rotation. Spin speeds are commonly known for use in extracting liquid from the laundry items in the basket 30, such as after a wash or rinse step in a treating cycle of operation. A loss motion device or clutch (not shown) can be included in the drive system 40 and can selectively operably couple the motor 41 with either the basket 30 and/or the laundry mover 38.

A suspension system 22 can dynamically hold the tub 34 within the cabinet 14. The suspension system 22 can dissipate a determined degree of vibratory energy generated by the rotation of the basket 30 and/or the laundry mover 38 during a treating cycle of operation. Together, the tub 34, the basket 30, and any contents of the basket 30, such as liquid and laundry items, define a suspended mass for the suspension system 22.

A liquid supply system can include a water supply system 44 and a dispensing system 54. The water supply system 44 can be configured to supply hot or cold water. The water supply system 44 can include a hot water inlet 45, a cold water inlet 46, a valve assembly and various conduits. The valve assembly can include a hot water valve 48, a cold water valve 49, and a diverter valve 55. Components of the valve assembly couple to various conduits including, but not limited to, a supply conduit 52, a first water conduit 56, and a second water conduit 58; which can provide selective distribution from the hot water inlet 45 and cold water inlet 46. The hot water valve 48 and cold water valve 49 are selectively openable to provide water, such as from a household water supply (not shown) to the supply conduit 52. The hot water and cold water valves 48, 49 can be opened individually or together to provide a mix of hot and cold water at a selected temperature. While the hot water and cold water valves 48, 49 and supply conduit 52 are illustrated exteriorly of the cabinet 14, it can be understood that these components can be internal to the cabinet 14.

A liquid recirculation system can be provided for recirculating liquid from the tub 34 into the treating chamber 32. More specifically, the sump 60 can be located in the bottom of the tub 34 and the liquid recirculation system can be configured to recirculate treating liquid from the sump 60 onto the top of a laundry load located in the treating chamber 32. A pump 62 can be housed below the tub 34 and can have an inlet fluidly coupled with the sump 60 and an outlet configured to fluidly couple to either or both a household drain 64 or a recirculation conduit 66. In this configuration, the pump 62 can be used to drain or recirculate wash water in the sump 60. As illustrated, the recirculation conduit 66 can be fluidly coupled with the treating chamber 32 such that it supplies liquid into the open top of the basket 30. In another example, the recirculation conduit 66 can be fluidly connected with various conduits. Various conduits can include, but are not limited to, the supply conduit 52, the first water conduit 56, or the second water conduit 58. Further, the liquid recirculation system can include other types of recirculation systems.

It is noted that the illustrated drive system, suspension system, liquid supply system, and liquid recirculation system are shown for exemplary purposes only and are not limited to the systems shown in the drawings and described above. For example, the liquid recirculation system and the liquid supply system can differ from the configuration shown, such as by inclusion of other valves, pumps, conduits, wash aid dispensers, heaters, sensors, such as water level sensors and temperature sensors, and the like, to control the flow of treating liquid, (i.e. water or treating chemistries), through the washing machine 10 and for the introduction of more than one type of treating chemistries. For example, the liquid supply system can be configured to supply liquid into the interior of the tub 34 not occupied by the basket 30 such that liquid can be supplied directly to the tub 34 without having to travel through the basket 30. In another example, the liquid supply system can include a single valve for controlling the flow of water from the household water source. In another example, the recirculation and pump system can include two separate pumps for recirculation and draining, instead of the single pump as previously described.

The washing machine 10 can further include a controller 70 coupled with various working components of the washing machine 10 to control the operation of the working components and to implement one or more treating cycles of operation. A user interface 26 can be operably coupled with the controller 70. The user interface 26 can include one or more knobs, dials, switches, push buttons, displays, touch screens and the like for communicating with the user, such as to receive input and provide output. The user can enter different types of information including, without limitation, cycle selection and cycle parameters, such as cycle options.

Figure 2:
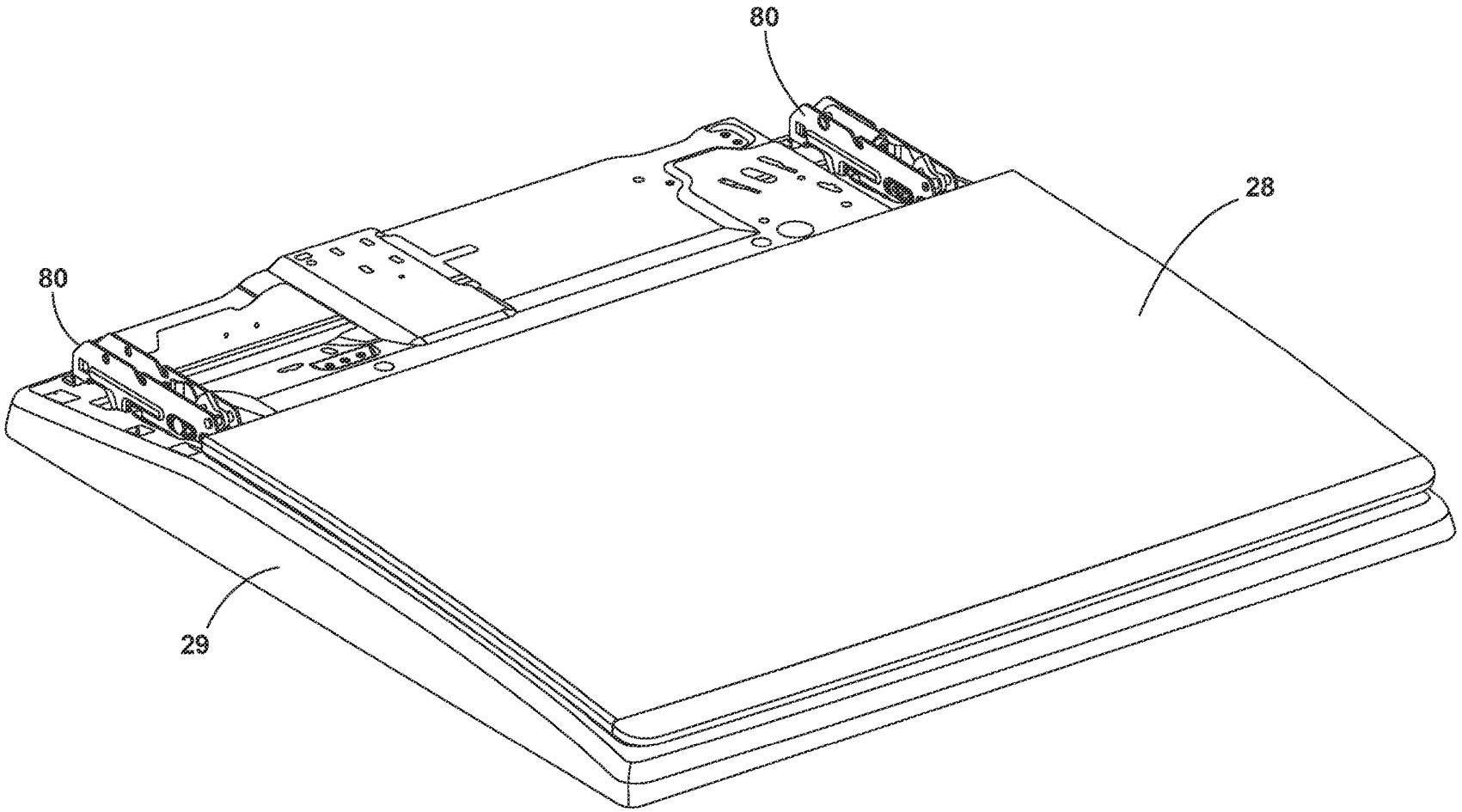
FIG. 2 is a perspective view of a cabinet shroud of the laundry treating appliance of FIG. 1 illustrating a pair of hinges for attaching a lid to the cabinet.

FIG. 2 illustrates the shroud 29 and a pair of hinges 80 for attaching the lid 28 to the cabinet 14 according to an aspect or the disclosure herein. Each of the hinges 80 can be mounted on top of the cabinet shroud 29 to allow pivotable movement of the lid 28 to open and close the access opening 15 in the shroud 29. As illustrated, the pair of hinges 80 are located in each of the back corners of the shroud 29.

Figure 3:
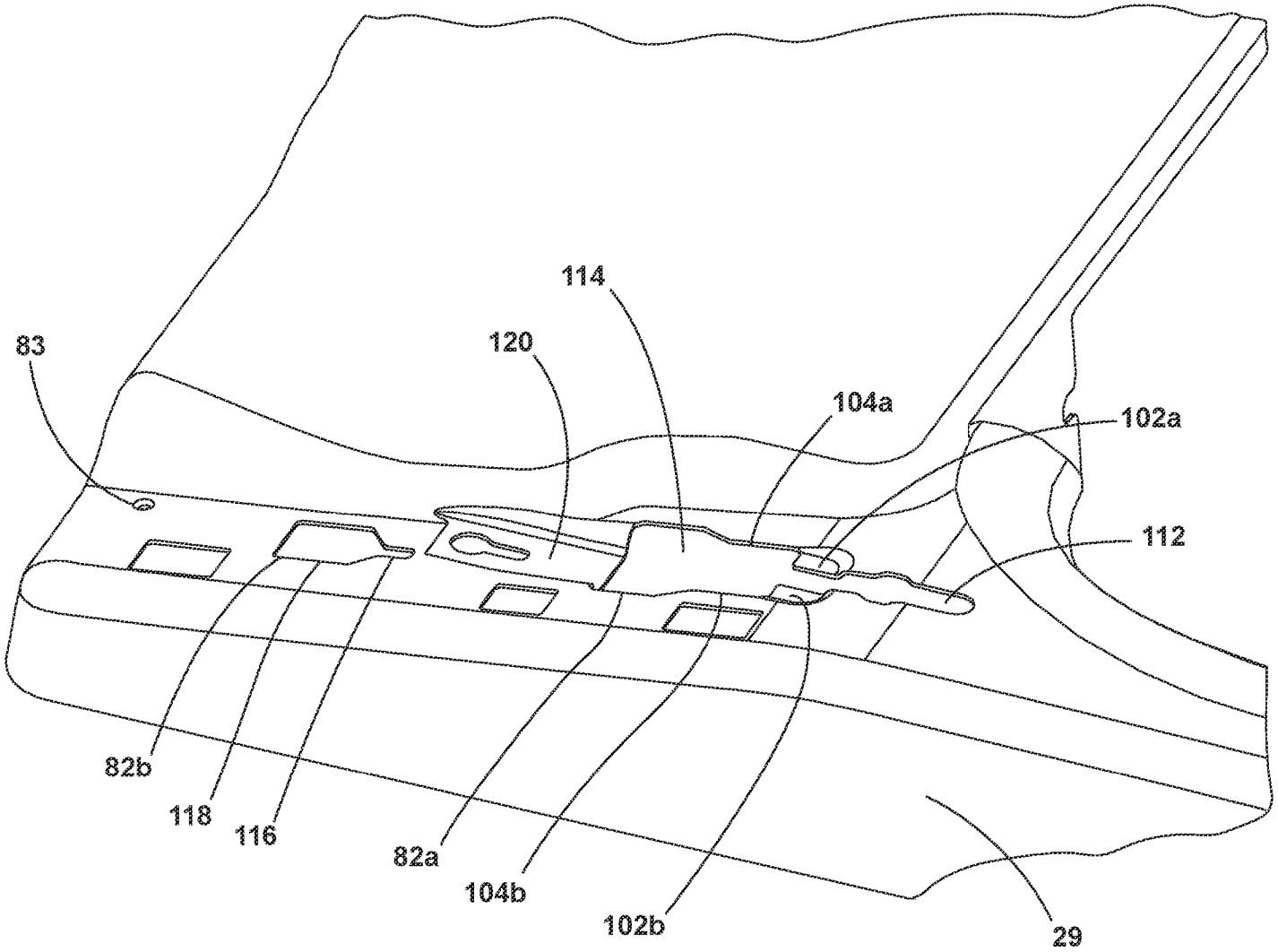
FIG. 3 is a perspective close-up view of a back corner of the cabinet shroud of FIG. 1 before one of the hinges is attached.

FIG. 3 shows a close-up of a back corner of the shroud 29 before one of hinges 80 is attached. In this exemplary illustration, the top of the shroud 29 comprises a plurality of apertures, 82*a* and 82*b* and a fastener aperture 83. Aperture 82*a* can have an elongated slot portion 112 that transitions into a generally rectangular portion 114. At the transition are flattened lip portions 102*a*, 102*b* that define a portion of the top of the rectangular portion 114 and the entrance to the elongated slot portion 112. Perpendicular to lip portions 102*a*, 102*b* are side wall edges 104*a*, 104*b*. Aperture 82*b* can generally be a bottle shape defined by a slightly elongated slot portion 116 opening up to a generally rectangular portion 118. Flat surface 120 on the shroud 29 transitions between aperture 82*a* and 82*b*. Fastener aperture 83 can generally be a circular aperture for receiving a screw. As will be explained, each of the apertures 82*a*, 82*b*, are configured to be engaged by portions of hinge 80.

Figure 4:
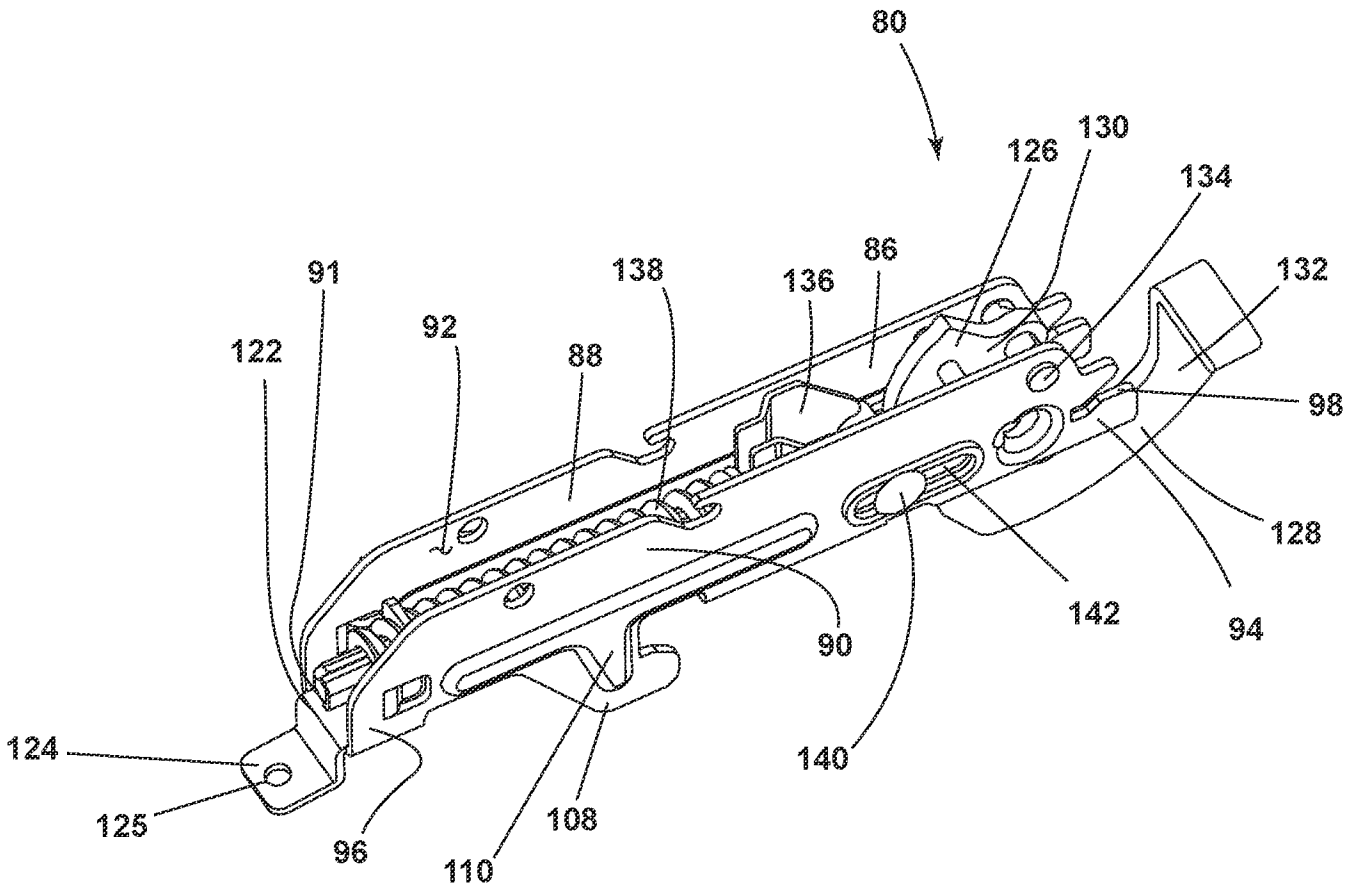
FIG. 4 is a top perspective view of a hinge of G. 2 as contemplated by the present disclosure.
Figure 5:
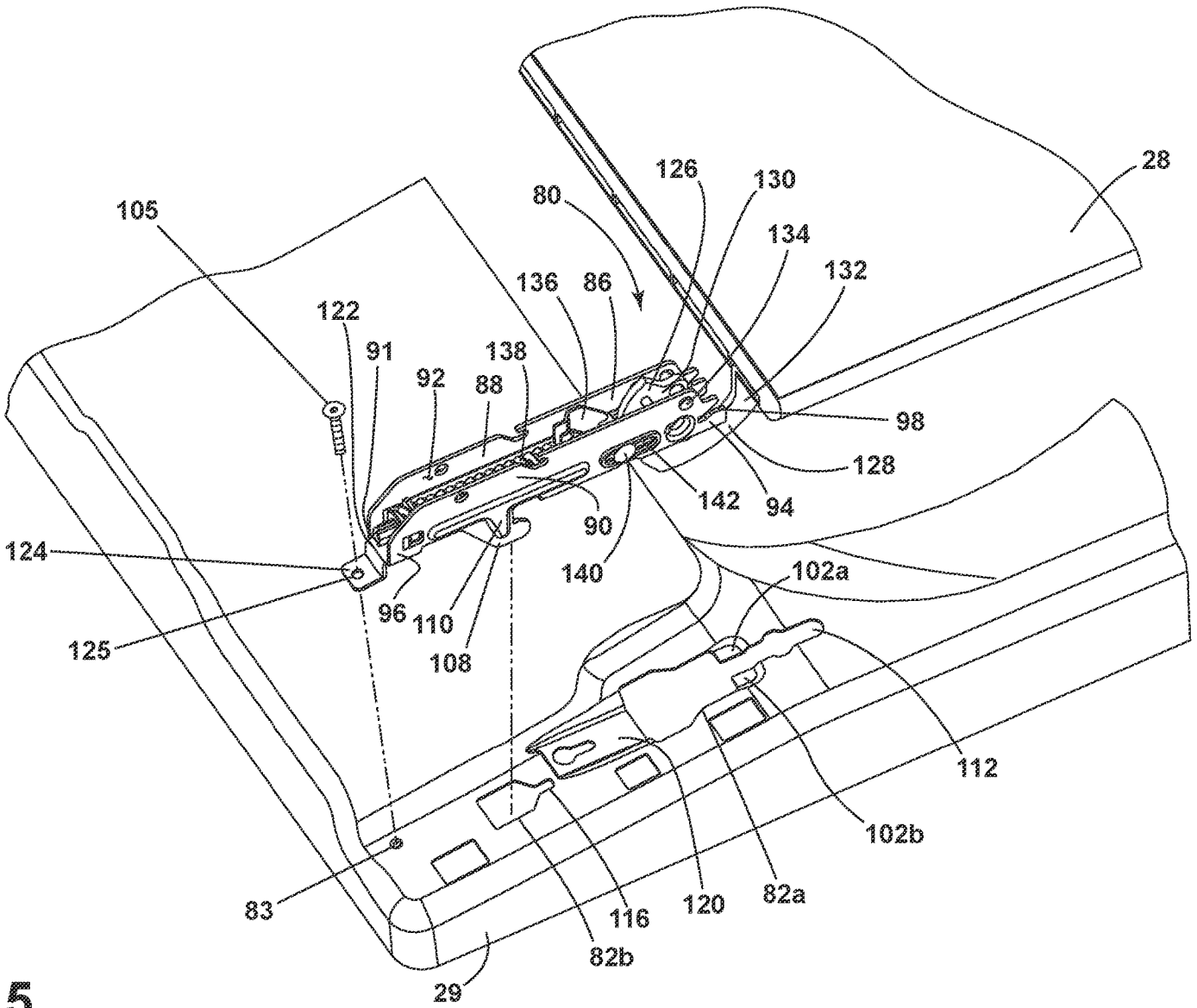
FIG. 5 is a top perspective view of a hinge of FIG. 2 for installation on the cabinet shroud of FIG. 3.

FIG. 4 illustrates a standalone hinge 80 of the present disclosure and FIG. 5 illustrates a top perspective view of the hinge 80 as aligned with the shroud 29. Each of hinges 80 can be comprised of a housing 86 having a pair of side walls 88, 90 connected by a bottom support wall 91 that together define a u-shaped channel 92. The bottom of u-shaped channel 92 is configured to rest on flat surface 120 when the hinge 80 is mounted to the shroud 29.

The housing 86 has a first end 94 and a second end 96, each of the first and second ends 94, 96 are configured to be securely attached to the shroud 29 to hold the hinge 80 in place. At the first end 94, each of the first and second side walls 88, 90 can have a generally horizontal v-shaped mouth 98 for engaging with the shroud 29. The v-shaped mouth 98 can be slid over the lip portion 102*a*, 102*b* to hold the first end 94 of the housing 86 in place on the shroud 29. As should be recognized, side wall edges 104*a*, 104*b* are proximate to and can abut side walls 88, 90 when the v-shaped mouth 98 of the housing 86 is engaged with lip portions 102*a*, 102*b*, respectively, to prevent the hinge 80 from moving from side-to-side.

The second end 96 of the housing 86 can also be securely fastened to shroud 29. As illustrated, bottom support wall 91 transitions to an s-shaped fastener 122. The s-shaped fastener 122 can have a tab 124 configured to abut shroud 29 and overlay fastener aperture 83. Tab 124 can be provided with aperture 125 for allow allowing a fastener such as a screw 105 to securely fasten the second end 96 of the housing 86 to the shroud via fastener aperture 83. As one of skill in the art should recognize there are many ways to fasten the second end 96 of the housing 86 to the shroud 29 without departing from the scope of the disclosure.

Also extending from the bottom support wall 91 of u-shaped channel 92 can be hook 108 having a neck 110. As illustrated, the hook 108 can be located nearer the second end 96 of the housing 86 than the first end 94. The hook 108 can be configured to be inserted though the aperture 82*b* such that when the hinge 80 is fastened to the shroud 29, the neck 110 is sandwiched in the slightly elongated slot portion 116. The hook 108 can abut the underside of shroud 29 thus helping prevent the hinge 80 from moving after the second end 96 of the housing 86 is securely attached to the shroud 29.

The housing 86 can also comprise a bracket 126 located in the channel 92 and defined by a c-shaped arm 128 to allow for pivotal movement of the lid 28. The c-shaped arm 128 can have a first end 130 pivotally connected between side wall 88, 90 via pin 134. The second end 132 of the c-shaped arm 128 can be integrally formed with or securely fastened to lid 28. When the hinge 80 is mounted to the shroud 29, the c-shaped arm 128 extends into the elongated slot portion 112 of aperture 82*a*. In this way, the arm 128 is hidden from view to a user and can freely, move in the elongated slot portion 112 to allow the lid 28 to open and close the access opening 15.

The housing 86 can also comprise a spring yoke 136 and a spring 138 positioned in the channel 92 for applying a torque on c-shaped arm 128 for counter-balancing the weight of the lid 28. In the exemplary embodiment illustrated, rivet 140 is connected to spring yoke 136 and passes through side walls 88, 90 in slot 142. In the closed position, spring 136 pulls on spring yoke 138 in engagement with c-shaped arm 128, thus reducing the force required to open the lid 28 by a user. In the open position, the spring 138 pushes on spring yoke 136, thus reducing the force required to close the lid 28 by a user.

Figure 6:
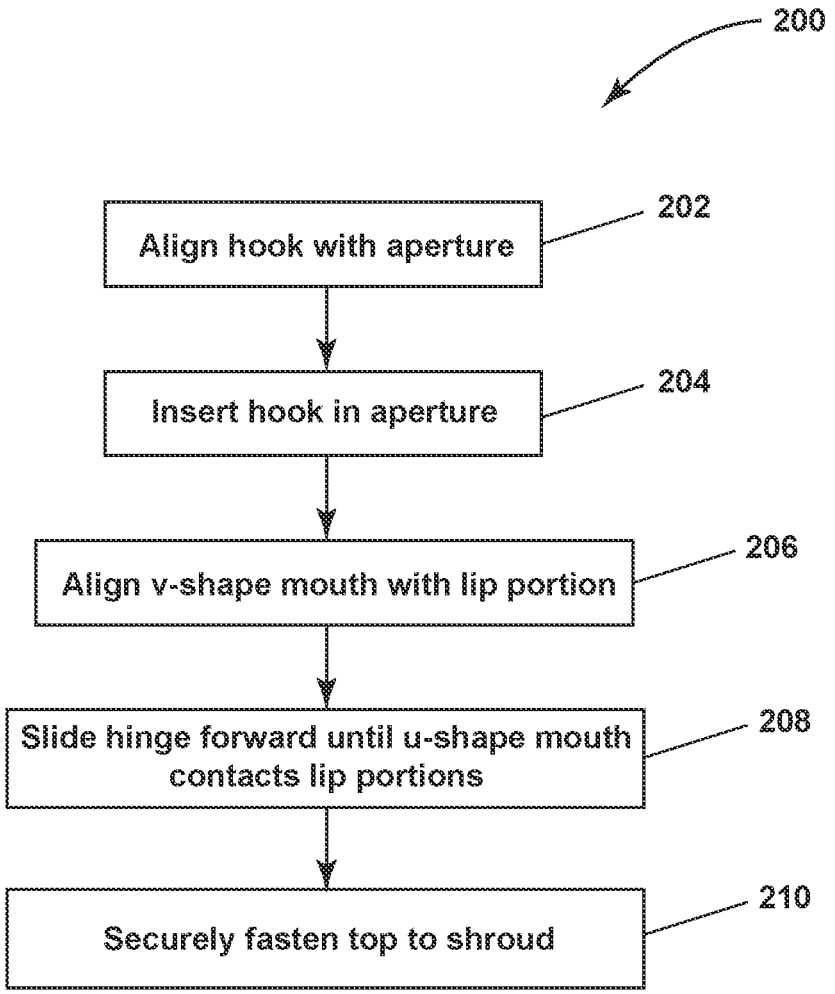
FIG. 6 depicts a method of installing one of the hinges of F. 2 on the cabinet shroud.

FIG. 6 depicts a method 200 of installing the hinge 80 on the shroud 29. In the first step 202, the hook 108 can be aligned with aperture 82*b*. Once aligned, the hook 108 can be vertically dropped through the aperture 82*b* as depicted in step 204. In step 206, the v-shaped mouth on the first end can be aligned with lip portions 102*a*, 102*b* on shroud 29. With the hook 108 in aperture 82*b* and v-shaped mouth aligned with lip portions 102*a*, 102*b*, in step 208, the hinge 80 can be slid forward into its final position where the v-shaped mouth is engaged with lip portions 102*a*, 102*b* and neck 100 is sandwiched in slightly elongated slot portion 116. Once in this position, in step 210, screw 105 can be inserted through tab 124 to securely attach the hinge 80 to the shroud 29.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the disclosure has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

The invention claimed is:

1. A hinge for a laundry treating appliance having a lid, the hinge comprising:

a housing having a portion received by an aperture in a shroud of the laundry treating appliance; the housing having a first end comprising a mouth adapted to couple with the shroud; and a bracket having a first end connected to the lid and a second end fastened to the housing and the bracket received in the aperture in the shroud.

2. The hinge of claim 1 wherein the housing defines a u-shaped channel.

3. The hinge of claim 1 wherein the housing is defined by a first wall and a second wall, each of the first and second walls comprising a mouth for mating with the shroud.

4. The hinge of claim 3 wherein the mouth is v-shaped.

5. The hinge of claim 4 wherein the v-shaped mouth slidably engages the shroud.

6. The hinge of claim 1 wherein the housing has a second end, spaced from the first end, and securely fastened to the shroud.

7. The hinge of claim 6 further comprising a screw for securely fastening the second end of the housing to the shroud.

8. The hinge of claim 1 further comprising a hook extending vertically from the housing.

9. The hinge of claim 8 wherein the hook is received in a second aperture in the shroud.

10. The hinge of claim 9 wherein the hook further comprises a neck that slidably engages in an elongated portion in the second aperture.

11. A hinge for a laundry treating appliance having a lid, the hinge comprising:

a housing having a first end comprising a mouth adapted to couple with a shroud of the laundry treating appliance;

a bracket having a first end connected to the lid and a second end fastened to the housing and the bracket received in an aperture in the shroud; and a hook extending vertically from the housing.

12. The hinge of claim 11 wherein the housing comprises a portion received by the aperture in the shroud.

13. The hinge of claim 11 wherein the housing defines a u-shaped channel.

14. The hinge of claim 11 wherein the housing is defined by a first wall and a second wall, each of the first and second walls comprising a mouth for mating with the shroud.

15. The hinge of claim 14 wherein the mouth is v-shaped.

16. The hinge of claim 15 wherein the v-shaped mouth slidably engages the shroud.

17. The hinge of claim 11 wherein the housing has a second end, spaced from the first end, and securely fastened to the shroud.

18. The hinge of claim 17 further comprising a screw for securely fastening the second end of the housing to the shroud.

19. The hinge of claim 11 wherein the hook is received in a second aperture in the shroud.

20. The hinge of claim 19 wherein the hook further comprises a neck that slidably engages an elongated portion in the second aperture.

* * * * *